US009954343B2

(12) United States Patent
Engelhardt et al.

(10) Patent No.: US 9,954,343 B2
(45) Date of Patent: Apr. 24, 2018

(54) LASER SPARK PLUG HAVING AN IMPROVED SEAL BETWEEN THE COMBUSTION CHAMBER WINDOW AND THE CASING

(71) Applicant: Robert Bosch GmbH, Stuttgart (DE)

(72) Inventors: Joerg Engelhardt, Ditzingen (DE); Dieter Wolz, Stuttgart (DE); Juergen Raimann, Weil der Stadt (DE); Pascal Woerner, Korntal-Muenchingen (DE); Martin Weinrotter, Vitoria-Gasteiz (ES)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 15/015,913

(22) Filed: Feb. 4, 2016

(65) Prior Publication Data

US 2016/0153421 A1 Jun. 2, 2016

Related U.S. Application Data

(63) Continuation of application No. 14/361,032, filed as application No. PCT/EP2012/068792 on Sep. 24, 2012.

(30) Foreign Application Priority Data

Nov. 28, 2011 (DE) ..... 10 2011 087 192

(51) Int. Cl.
*F02P 23/04* (2006.01)
*H01T 13/06* (2006.01)
*H01T 14/00* (2006.01)

(52) U.S. Cl.
CPC ..... *H01T 13/06* (2013.01); *F02P 23/04* (2013.01); *H01T 14/00* (2013.01)

(58) Field of Classification Search
CPC . F02P 23/04; F02P 13/00; F02P 9/007; F02M 57/06; F02M 27/04; F23C 2900/99003
See application file for complete search history.

(56) References Cited

U.S. PATENT DOCUMENTS 5,515,681 A * 5/1996 DeFreitas ..... F23Q 13/00 60/39.821
5,590,517 A * 1/1997 DeFreitas ..... F23D 11/32 60/39.826
6,053,140 A * 4/2000 Feichtinger ..... F02P 23/045 123/143 B (Continued)

FOREIGN PATENT DOCUMENTS

DE 102007041528 3/2009
EP 1820948 8/2007

(Continued)

OTHER PUBLICATIONS

Machine translation of WO 2010139577A1.*

(Continued)

*Primary Examiner* — Long T Tran
(74) *Attorney, Agent, or Firm* — Norton Rose Fulbright US LLP; Gerard Messina

(57) ABSTRACT

A casing for a laser spark plug, in particular, of an internal combustion engine of a motor vehicle, or of a stationary engine; the casing including at least one casing part and a combustion chamber window joined to the casing part to form a seal at least regionally; characterized in that at least one sealing element, whose coefficient of thermal expansion at an operating temperature of the laser spark plug is greater than the coefficient of thermal expansion of the casing part at the operating temperature of the laser spark plug, is provided between the casing part and the combustion chamber window.

32 Claims, 5 Drawing Sheets

(56) References Cited

U.S. PATENT DOCUMENTS

| | | | | |
|---|---|---|---|---|
| 6,212,989 | B1 * | 4/2001 | Beyer | F41H 5/263 102/201 |
| 7,699,033 | B2 * | 4/2010 | Bihari | F02P 5/1512 123/143 B |
| 2009/0159032 | A1 * | 6/2009 | Gruber | F02P 23/04 123/143 B |
| 2010/0263615 | A1 * | 10/2010 | Weinrotter | F02P 23/04 123/143 B |
| 2010/0275867 | A1 * | 11/2010 | Weinrotter | F02P 23/04 123/143 B |
| 2011/0203542 | A1 * | 8/2011 | Weinrotter | F02C 7/264 123/143 B |
| 2012/0024250 | A1 * | 2/2012 | Weyl | F02C 7/264 123/143 B |
| 2012/0125287 | A1 * | 5/2012 | Chiera | F02B 19/12 123/254 |

FOREIGN PATENT DOCUMENTS

| | | | | |
|---|---|---|---|---|
| WO | 2009/097635 | | 8/2009 | |
| WO | 2010/086287 | | 8/2010 | |
| WO | WO 2010139577 | A1 * | 12/2010 | F02P 23/04 |
| WO | WO 2011147606 | A1 * | 12/2011 | F02P 23/04 |

OTHER PUBLICATIONS

Helmut Ranner et al : "Optical windows for combustion research and control applications : Anti-fouling strategies" IFRF Combustion Journal, Bd. 200705, Nr. Aug. 2007, Aug. 1, 2007, XP055049317.

Eberhard Roos et al : "Kapitel 7. Nichteisenmetalle". Jan. 1, 2011 Werkstoffkunde Fur Ingenieure Grundlagen, Anwendung, Prufung, Berlin Springer, pp. 225-273, XP009163776, ISBN: 3-642-17463-9.

* cited by examiner

LASER SPARK PLUG HAVING AN IMPROVED SEAL BETWEEN THE COMBUSTION CHAMBER WINDOW AND THE CASING

CROSS-REFERENCE TO RELATED APPLICATIONS

The present application is a continuation of U.S. patent application Ser. No. 14/361,032, which is a national phase of International Pat. App. No. PCT/EP2012/068792 filed Sep. 24, 2012, and which claims priority to DE 10 2011 087 192.6, filed in the Federal Republic of Germany on Nov. 28, 2011, all of which are hereby incorporated herein by reference in their entireties.

FIELD OF THE INVENTION

The present invention relates to a casing for a laser spark plug, in particular, of an internal combustion engine of a motor vehicle, or of a stationary engine; the casing including at least one casing part and a combustion chamber window joined to the casing part in a sealing manner in at least some areas.

BACKGROUND

German patent document DE 10 2007 041 528 A1 discusses a laser ignition device or laser spark plug for an internal combustion engine, including a laser-active solid body, a combustion chamber window and a casing, where the casing and the combustion chamber window are interconnected in a continuous material manner at least indirectly to seal off the interior chamber from the combustion chamber.

At one end of the casing facing the combustion chamber, there is a so-called combustion chamber window, which is able to transmit the laser beams generated in the ignition laser. This combustion chamber window must be accommodated in a casing of the ignition laser, so as to form a seal. There are strict requirements for the sealing between the combustion chamber window and the casing, since during operation of the internal combustion engine, surface temperatures of more than 600° C. may occur at the combustion chamber window. In addition, there are also intermittent compressive loads of up to 300 bar. When an ignition laser is used for the ignition of a gas turbine, low pressures do prevail in the combustion chamber of the gas turbine, but the surface of the combustion chamber window may reach temperatures of up to 1000° C.; instances of uncontrolled ignition by incandescence always having to be prevented.

It is clear that the interior of the ignition laser must be reliably sealed from the extremely high temperatures and pressures. If the exhaust gases should happen to reach the interior of the ignition laser, this would lead to failure of the ignition laser.

SUMMARY

Accordingly, an object of the present invention is to further improve a casing for a laser spark plug, in order to provide an imperviousness of the casing, and therefore a service life of a laser spark plug having the casing, that is even further increased in comparison with the related art, without necessarily having to provide, for this, a continuous material connection that is complicated from the standpoint of production engineering.

In the case of a casing of the type mentioned at the outset, this object of the present invention is achieved by providing at least one sealing element between the casing part and the combustion chamber window; the coefficient of thermal expansion of the sealing element at an operating temperature of the laser spark plug being greater than the coefficient of thermal expansion of the casing part at the operating temperature of the laser spark plug. In this manner, a thermally dependent linear expansion of the casing part, which is, in general, markedly greater than a corresponding, thermally dependent linear expansion of the combustion chamber window, may be compensated for at least partially.

For example, the at least one casing part may be formed to accommodate the sealing element and the combustion chamber window in such a manner, that an approximately annular contact surface between the sealing element and the casing part is produced, via which a preloading force provided for purposes of sealing is transmittable in the axial direction, that is, substantially parallelly to an optical axis of the laser spark plug. The preloading force may be exerted directly on the combustion chamber window or the "layer construction" of the combustion chamber window and the sealing element, by, for example, a further casing part, which may be, e.g., axially screwed into the first casing part. Accordingly, a spatial region, which accommodates the combustion chamber window and the sealing element, and whose inner axial dimension, in particular, has a temperature dependence, which is essentially a function of the coefficient of linear expansion of the first casing part, is defined between the first casing part and the further casing part.

Therefore, when the casing is heated up to the operating temperature of the laser spark plug, the inner axial dimension of the spatial region increases relatively steeply, while an axial longitudinal expansion of the combustion chamber window essentially parallel to this is relatively low, which means that an unwanted reduction in the axial preloading force is generated. Due to the selection of the present invention of the thermal expansion coefficient for the sealing element also situated in the spatial region, because of its relatively large linear thermal expansion in the axial direction, which is greater than that of the first casing part, the sealing element offsets the relatively low linear thermal expansion of the combustion chamber window at least partially or compensates for it almost completely, which means that the preloading force necessary for the sealing action is essentially maintained even in the event of large temperature fluctuations.

In one advantageous specific embodiment, it is provided that the coefficient of thermal expansion of the combustion chamber window at the operating temperature of the laser spark plug be less than the coefficient of thermal expansion of the casing part at the operating temperature of the laser spark plug.

In one further advantageous specific embodiment, it is provided that the coefficient of thermal expansion of the combustion chamber window at the operating temperature of the laser spark plug be between approximately 4*10^−6/K (Kelvin) and approximately 10*10^−6/K, in particular, approximately 6*10^−6/K. These values are attainable, for example, using crystalline sapphire.

In a further advantageous specific embodiment, the coefficient of thermal expansion of the casing part at the operating temperature of the laser spark plug is between approximately 7*10^−6/K and approximately 16*10^−6/K, in particular, approximately 12*10^−6/K. These values are attainable, for example, using steel of type 1.4913 or similar (turbine steel, martensitic).

In a further advantageous specific embodiment, the coefficient of thermal expansion of the sealing element at the operating temperature of the laser spark plug is between approximately 16*10^-6/K and approximately 20*10^-6/K, in particular, approximately 18*10^-6/K. These values are attainable, for example, using steel of the type 1.4841 or similar (austenitic steel).

In a further advantageous specific embodiment, it is provided that the casing part and/or the sealing element be made of steel, the combustion chamber window being made of sapphire, in particular, monocrystalline sapphire.

In a further advantageous specific embodiment, it is provided that a thickness of the sealing element be between approximately 0.4 mm (millimeters) and approximately 3 mm, in particular, approximately 1.0 mm; particularly effective sealing action and particularly efficient compensation for the thermal expansion of the materials of the casing part and the combustion chamber window being simultaneously obtained. In particular, two sealing elements, in particular, sealing rings, may be provided, which are each approximately 1 mm thick and may be positioned in such a manner, that they form a layer construction, in the middle of which the combustion chamber window is situated. This dimensioning is particularly favorable in the case of a combustion chamber window having a thickness of approximately 4 mm.

In a further advantageous specific embodiment, it is provided that a thickness of the combustion chamber window be between approximately 2 mm and approximately 8 mm, in particular, approximately 4 mm; together with the casing part and the sealing element, particularly efficient compensation for the thermal expansion of the materials and effective optical characteristics for transmitting laser ignition pulses being produced.

In one further advantageous specific embodiment, in a region of contact with the at least one casing part and/or the combustion chamber window, the sealing element has a coating of a material that is different from the base material of the sealing element; the base material may be steel; and the coating may be made of copper or another ductile material (e.g., silver or suitable alloys).

In a further advantageous specific embodiment, the coating is made of, in particular, one copper layer per coating side, of a thickness between approximately 50 μm and approximately 150 μm, which may be, approximately 100 μm. According to tests of the Applicant, such a copper coating may be advantageously provided as a "filler," that is to say, as an actual sealing material, which may, advantageously, further level out the surface roughness of the components including the coating (casing part, combustion chamber window), in that the material of the sealing element or its coating spreads itself out into these contact surfaces of the components involved, for example, by creep, during the bracing or compressing at a specifiable preloading force. In a further advantageous specific embodiment, the flatness of the coating is, advantageously, approximately 2 μm or better.

According to a further advantageous specific embodiment, the coating, in particular, copper coating, may be advantageously applied to the sealing element and/or to the at least one casing part galvanically or by similar coating methods. In the case of a galvanic coating, care must be taken that the copper coating have an effective bond with the base material, for example, steel of type 1.4841.

Instead of a copper-coated or copper-plated sealing disk, a copper foil (which may be a thickness of approximately 50 μm to approximately 150 μm) and a sealing disk made of steel, e.g., of the type 1.4841, may be used, through which effective offsetting of the thermal expansion is again produced. The copper foil may also be rolled onto the sealing disk. The copper foil may also be applied to both sides of the sealing element in an advantageous manner, that is, between the sealing element and the combustion chamber window and between the sealing element and the casing part.

In one further advantageous specific embodiment, it is provided that in a region of contact with the at least one casing part and/or with the combustion chamber window, the sealing element have a lapped surface, through which further increased sealing action is provided.

In a further advantageous specific embodiment, the at least one casing part is pressed against the combustion chamber window by a specifiable preloading force. The specifiable preloading force advantageously allows particularly effective sealing action between the casing part in question and the combustion chamber window. In addition, by using a specified, i.e., known preloading force, a prediction about the imperviousness attained and the approximate service life of the casing and the laser spark plug to be expected may be made, in contrast to conventional systems, in which a mechanical connection of the components (casing parts, combustion chamber window) is also provided, indeed, but the physical variables of this connection are neither exactly defined, nor controlled.

In one further advantageous specific embodiment, two or more sealing elements, whose coefficients of thermal expansion at the operating temperature of the laser spark plug are different from one another, are provided between the casing part and the combustion chamber window, which means that further degrees of freedom are given to compensate for the thermal linear expansion.

A laser spark plug having a casing of the present invention is provided as a further arrangement for attaining the object of the present invention, where an operating temperature of the laser spark plug is between approximately 200° C. and approximately 1100° C., in particular, between approximately 280° C. and approximately 600° C.

Additional features, possible uses and advantages of the present invention are derived from the following description of exemplary embodiments of the present invention, which are illustrated in the figures of the drawing. In this context, all of the described or illustrated features form the subject matter of the present invention, either alone or in any combination, irrespective of their combination in the patent claims or their antecedent references, and also irrespective of their wording and illustration in the description and in the drawing, respectively.

DETAILED DESCRIPTION

Figure 5:
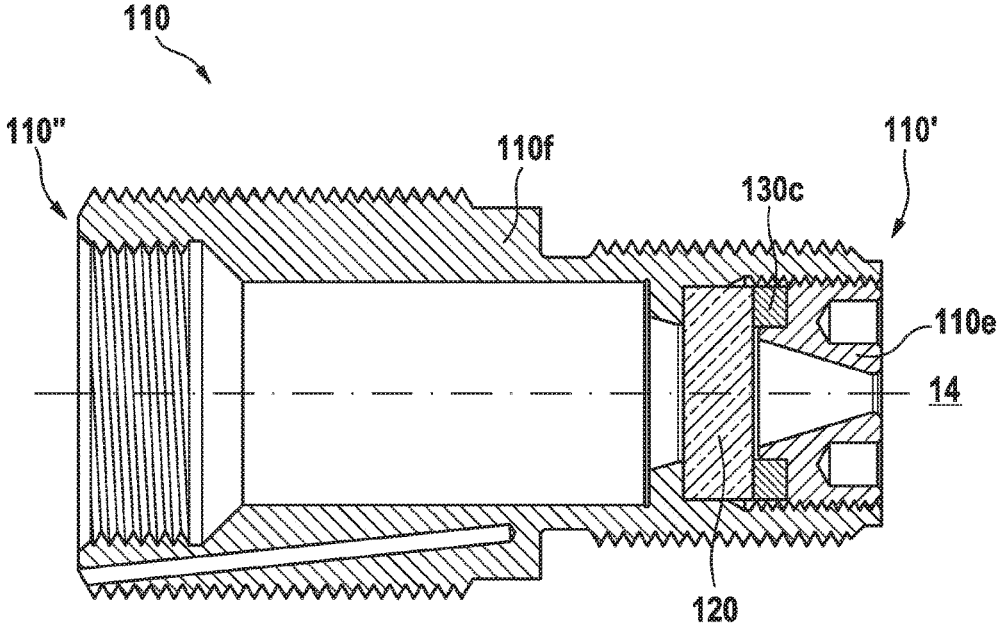
FIG. 5 shows a schematic cross section of a further specific embodiment of the casing according to the present invention.
Figure 6:
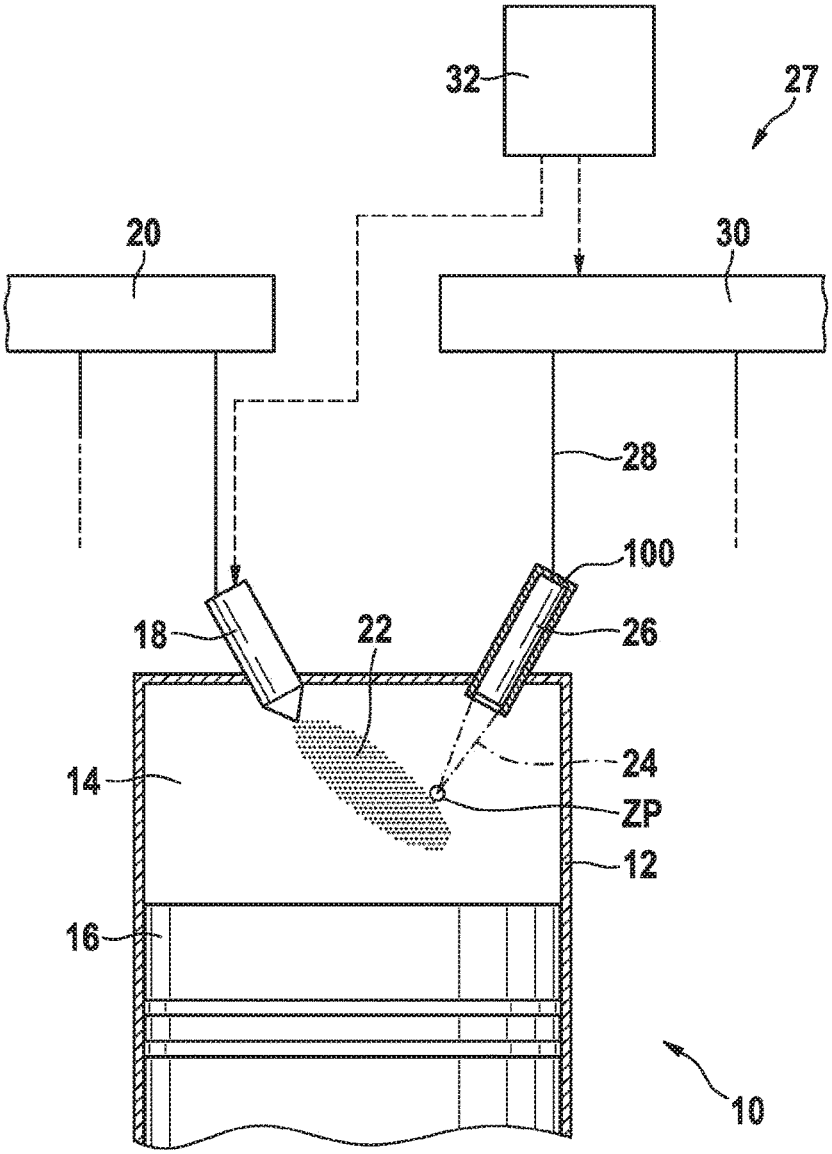
FIG. 6 shows a schematic of a laser-based ignition system for an internal combustion engine.

In FIG. 6, an internal combustion engine is designated, on the whole, by reference numeral 10. It may be used for propelling a motor vehicle not shown. Internal combustion engine 10 usually includes several cylinders, only one of which is denoted in FIG. 5 by the reference numeral 12. A combustion chamber 14 of cylinder 12 is delimited by a piston 16. Fuel reaches combustion chamber 14 directly through an injector 18, which is connected to a fuel pressure reservoir 20 that is also referred to as a rail. Alternatively, the fuel-air mixture may also be formed outside of the combustion chamber, for example, in the intake manifold or, in the case of stationary engines, in front of the turbocharger as well.

The fuel-air mixture 22 present in combustion chamber 14 is ignited by a laser pulse 24, which is radiated into combustion chamber 14, in this instance, onto ignition point ZP, by an ignition device 27 that includes an ignition laser 26. To this end, laser device 26 is supplied with pumping light via a fiber optic device 28 for the optical pumping of laser device 26; the pumping light being provided by a pumping light source 30. Alternatively, pumping light source 30 may also be accommodated directly in the laser spark plug, and consequently, the need for optical waveguide 28 is eliminated. Pumping light source 30 is controlled by a control unit 32, which also controls injector 18.

In an exemplary implementation, ignition laser 26 from FIG. 6 is advantageously integrated in a laser spark plug 100, which may be mounted, for example, in a region of the cylinder head of internal combustion engine 10 in a manner comparable to conventional high-voltage spark plugs.

Figure 1:
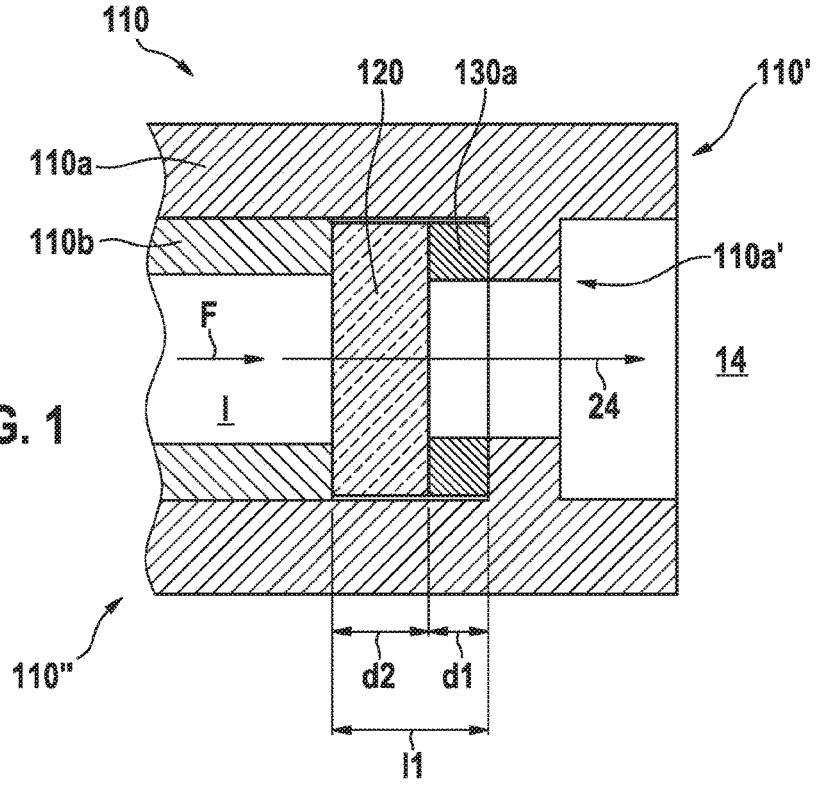
FIG. 1 shows a schematic cross section of a first specific embodiment of the casing according to the present invention.

According to the present invention, laser spark plug 100 includes a casing having the characteristics described below with reference to FIG. 1. FIG. 1 shows a cross section of a portion of casing 110, which includes an end region 110', which faces the combustion chamber and, in the installed state of laser spark plug 100 or casing 110 in an internal combustion engine 10 (FIG. 6), borders on at least a portion of combustion chamber 14 or extends into it. Ignition laser 26 is situated, for example, in an interior chamber I of a region 110" of casing 110 facing away from the combustion chamber. In a further specific embodiment, pumping light source 30 may also be situated in laser spark plug 100.

As is apparent from FIG. 1, casing 110 includes at least one first casing part 110*a*, which is, in this case, substantially sleeve-shaped and accommodates a combustion chamber window 120. Casing 110 further includes a second casing part 110*b*, which is movable relative to first casing part 110*a* in an axial direction, thus, horizontally in FIG. 1, using, for example, a screw thread not illustrated. Together with a shoulder 110*a*' of first casing part 110*a*, second casing part 110*b* delimits a spatial section, which receives combustion chamber window 120 and a substantially disk-shaped or annular sealing element 130*a*.

In this manner, combustion chamber window 120 is joined to first casing part 110*a*, that is, to shoulder 110*a*', so as to form a seal at least regionally, which means that interior chamber I of casing 110 is shielded from combustion chamber 14.

According to the present invention, a coefficient of thermal expansion of sealing element 130*a* at the operating temperature of laser spark plug 100 is greater than the coefficient of thermal expansion of casing part 110*a* at the operating temperature of laser spark plug 100, which means that a normally lower coefficient of thermal expansion of combustion chamber window 120 at the operating temperature of laser spark plug 100 may be at least partially compensated for. Optionally, two sealing elements (not shown in FIG. 1), which are positioned in front of and in back of the combustion chamber window in the axial direction, may also be provided, cf. FIG. 3. Then, the principle of the present invention with regard to the coefficients of thermal expansion of the sealing element is advantageously applicable to at least one of the sealing elements, but, particularly, may be applicable to the two sealing elements as well.

For example, an axial preloading force necessary for the sealing action in the region of sealing element 130*a* may be applied with the aid of further casing part 110*b*, e.g., by screwing further casing part 110*b* suitably far into first casing part 110*a* (in FIG. 1, from left to right). Accordingly, preloading force F acts upon the "layer construction" made up of combustion chamber window 120 and sealing element 130*a*.

In particular, inner axial dimension 11 of the spatial region containing components 120, 130*a* has a temperature dependence, which is essentially a function of the thermal expansion coefficient of first casing part 110*a*. Therefore, when casing 110 is heated up to the operating temperature of laser spark plug 100, inner axial dimension 11 of the spatial region increases relatively steeply, while a longitudinal expansion of combustion chamber window 120 essentially parallel to this, thus, the thermally dependent change in thickness d2, is relatively low, which means that an unwanted reduction in axial preloading force F is generated.

Due to the selection of the present invention of the thermal expansion coefficient for the sealing element 130*a* also situated in the spatial region, because of its relatively large linear thermal expansion in the axial direction, which is greater than that of first casing part 110*a*, the sealing element offsets the relatively low linear thermal expansion of combustion chamber window 120 at least partially or compensates for it almost completely, which means that the preloading force F necessary for the sealing action is essentially maintained even in the event of large temperature fluctuations.

That is, the selection of the coefficient of thermal expansion of the material of sealing element 130*a* according to the present invention allows a comparatively low increase in thickness d2 of combustion chamber window 120 in response to heating it to the operating temperature to be at least partially compensated for by a comparatively large increase in thickness d1 of sealing element 130*a*, which means that the increase in inner axial dimension 11, which is also comparatively large, is countered with the intention of maintaining preloading force F.

In one advantageous specific embodiment, it is provided that the coefficient of thermal expansion of combustion chamber window 120 at the operating temperature of laser spark plug 100 be less than the coefficient of thermal expansion of casing part 110*a* and/or 110*b* at the operating temperature of laser spark plug 100.

In one further advantageous specific embodiment, it is provided that the coefficient of thermal expansion of combustion chamber window 120 at the operating temperature of laser spark plug 100 be between approximately 4*10^−6/K (Kelvin) and approximately 10*10^−6/K, in particular, approximately 8*10^−6/K. These values are attainable, for example, using crystalline sapphire.

In a further advantageous specific embodiment, the coefficient of thermal expansion of casing part 110*a* and/or 110*b* at the operating temperature of laser spark plug 100 is between approximately 7*10^-6/K and approximately 16*10^-6/K, in particular, approximately 12*10^-6/K. These values are attainable, for example, using steel of type 1.4913 or similar (turbine steel).

In a further advantageous specific embodiment, the coefficient of thermal expansion of sealing element 130*a* at the operating temperature of laser spark plug 100 is between approximately 16*10^-6/K and approximately 20*10^-6/K, in particular, approximately 18*10^-6/K. These values are attainable, for example, using steel of type 1.4841 or similar.

In a further advantageous specific embodiment, it is provided that casing part 110*a*, 110*b* and/or sealing element 130*a* be made of steel (which may be of a different type to produce different coefficients of thermal expansion); combustion chamber window 120 being made of sapphire, in particular, monocrystalline sapphire.

In a further advantageous specific embodiment, it is provided that a thickness d1 of sealing element 130*a* be between approximately 0.4 mm and approximately 3 mm, in particular, approximately 1.0 mm; particularly effective sealing action and particularly efficient compensation for the thermal expansion of the materials of casing part 110*a* and of combustion chamber window 120 being simultaneously obtained.

In a further advantageous specific embodiment, it is provided that a thickness d2 of combustion chamber window 120 be between approximately 2 mm and approximately 8 mm, in particular, approximately 4 mm; together with casing part 110*a* and sealing element 130*a*, particularly efficient balancing of the thermal expansion of the materials and effective optical characteristics for transmitting laser ignition pulses 24 being simultaneously produced (cf. FIG. 6, as well).

Figure 2A:
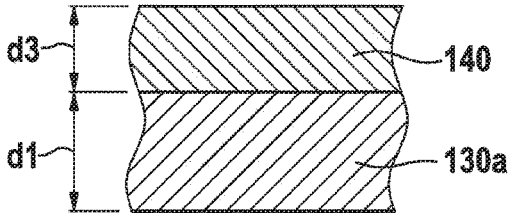
FIGS. 2*a*, 2*b* show different configurations of sealing elements.

In one further advantageous specific embodiment, which is schematically represented in FIG. 2*a*, sealing element 130*a* has, in a region of contact with the at least one casing part 110*a* (FIG. 1) and/or with combustion chamber window 120, a coating 140 (FIG. 2*a*) made of a material, which is different from the base material of sealing element 130*a*; base material 130*a* may be steel; and coating 140 may be made of copper or another ductile material. As an alternative, copper foil may also be used.

In a further advantageous specific embodiment, coating 140 is made of a copper layer of a thickness d3 between approximately 50 μm and approximately 150 μm, which may be, approximately 100 μm. According to tests of the Applicant, such a copper coating may be advantageously provided as a "filler," that is to say, as an actual sealing material, which may advantageously level out further the surface roughness of the components including the coating (casing part 110*a*, combustion chamber window 120), in that the material of the sealing element or its coating 140 spreads itself out into these contact surfaces of the components involved, for example, by creep, during the bracing or pressing at specifiable preloading force F.

In a further advantageous specific embodiment, the flatness of coating 140 is, advantageously, approximately 2 μm or better.

According to a further advantageous specific embodiment, coating 140, in particular, copper coating, may be advantageously applied to sealing element 130*a* galvanically or by similar coating methods.

Providing a coating 140 of the type mentioned above to regions of casing parts 110*a*, 110*b*, in particular, to their front-side end regions, which come into contact with elements 120, 130*a*, is also conceivable and may be accomplished with the aid of similar or identical manufacturing processes.

In the case of a galvanic coating, care must be taken that copper coating 140 have an effective bond with the base material, for example, steel of type 1.4841.

In a further advantageous specific embodiment, it is provided that in a region of contact with the at least one casing part 110*a* and/or with combustion chamber window 120, sealing element 130*a* have a lapped surface may have a maximum average surface roughness Rzmax of less than or equal to approximately 6, through which further increased sealing action is attained.

The surfaces of contact of casing parts 110*a*, 110*b* with combustion chamber window 120 and with sealing element 130*a* may also be advantageously lapped or, e.g., precision-turned so as to have turning grooves substantially concentric with respect to the longitudinal axis of the component in question. Grinding may also be considered. It further may be the case for the contact surfaces of casing parts 110*a*, 110*b* to also have a maximum average surface roughness Rzmax of less than or equal to approximately 6.

In a further advantageous specific embodiment, the at least one casing part 110*a* is pressed against combustion chamber window 120 at a specifiable preloading force F. The specifiable preloading force F of, e.g., approximately 5 kN (kilonewtons) to approximately 15 kN advantageously allows particularly effective sealing action between the casing part 110*a* in question and combustion chamber window 120 or sealing element 130*a*. In addition, the use of a specified, and thus, known preloading force F may allow a prediction to be made regarding the imperviousness attained and the approximate service life of casing 110 and laser spark plug 100 (FIG. 6) to be expected.

Figure 2B:
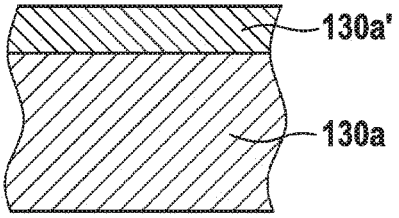

In one further advantageous specific embodiment, two or more sealing elements 130*a*, 130*a*', cf. FIG. 2*b*, whose coefficients of thermal expansion at the operating temperature of laser spark plug 100 are different from one another, are provided between casing part 110*a* and combustion chamber window 120, which means that further degrees of freedom are given to compensate for the thermal linear expansion.

An operating temperature of laser spark plug 100 is, for example, between approximately 200° C. and approximately 1100° C., in particular, between approximately 280° C. and approximately 600° C.

According to a further advantageous specific embodiment, the values of the coefficients of thermal expansion of the components and/or their ratios to one another, specified according to the present invention, may not only apply to the operating temperature of laser spark plug 100, but also to room temperature (e.g., approximately 20° C.), as well as, optionally, to the temperature range between room temperature and the operating temperature of the laser spark plug, which may be, at least between approximately 20° C. and approximately 400° C.

Figure 3:
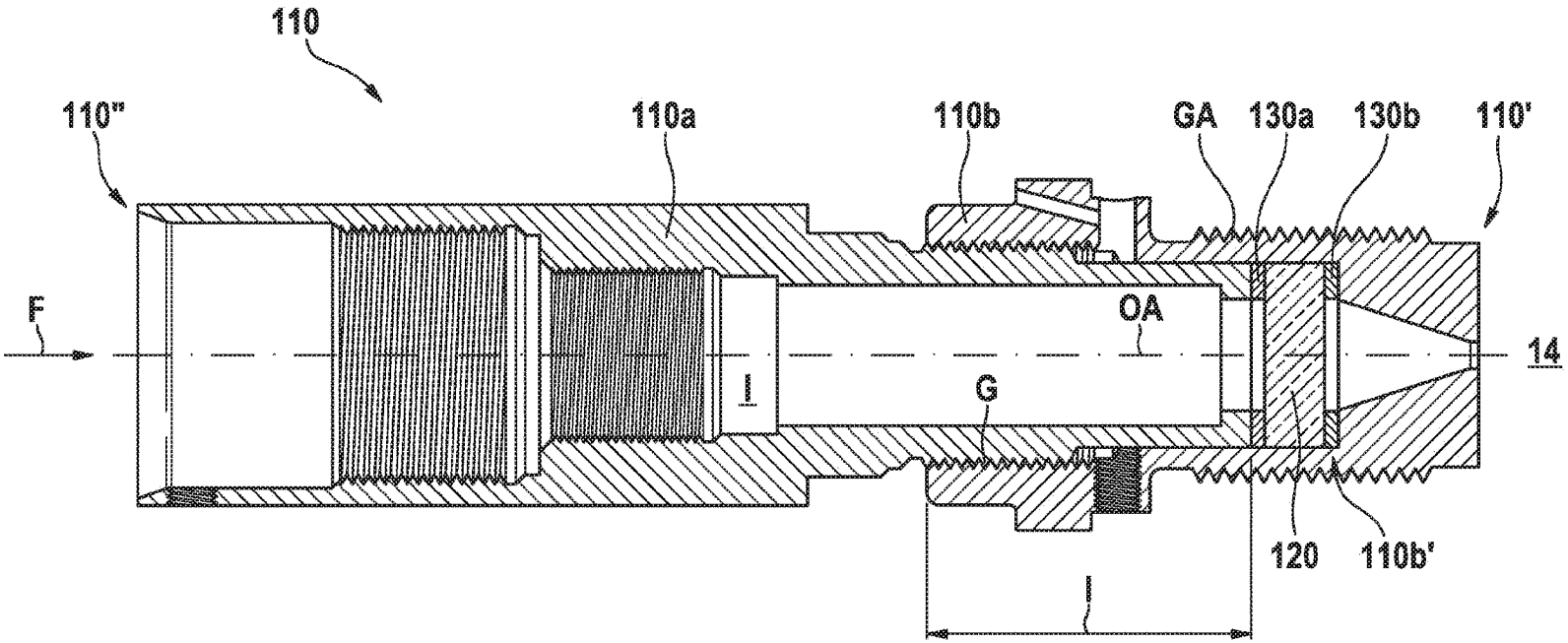
FIG. 3 shows a schematic cross section of a further specific embodiment of the casing according to the present invention.

FIG. 3 shows a cross section of a further specific embodiment of the casing according to the present invention. As is apparent from FIG. 3, casing parts 110*a*, 110*b* are each substantially sleeve-shaped and matched to one another in such a manner, that they are insertable into each other over a certain overlap length 1 and are coaxially alignable with each other. In this case, casing parts 110*a*, 110*b* may be joined with the aid of a screw thread G, which is situated at least partially in overlap region 1.

Casing 110 may also be advantageously attached to a cylinder head of internal combustion engine 10 (FIG. 6) via a screw connection; a corresponding external thread GA (FIG. 3) is provided on the casing part 110*b* facing the combustion chamber.

The part 110' of casing 110 facing the combustion chamber is essentially formed by casing part 110*b*, while a part 110" of casing 110 facing away from the combustion chamber is essentially formed by casing part 110*a*. In turn, e.g., components of laser device 26 from FIG. 6, in particular, a laser-active solid body, etc., may be situated in casing part 110*a*.

As is apparent from FIG. 3, combustion chamber window 120 is situated in an interior section of second casing part 110*b*. In particular, combustion chamber window 120 rests against an approximately annular step 110*b*' of the inner radius of second casing part 110*b*, which means that a substantially annular contact surface or sealing surface is accordingly produced on the surface of combustion chamber window 120 facing combustion chamber 14.

In contrast, a second surface of combustion chamber window 120 facing interior chamber I of casing 110 also has, for instance, a substantially annular sealing surface, which is defined by a contact surface between combustion chamber window 120 and a front-side end region of sleeve-shaped, first casing part 110*a*.

According to a specific embodiment, both of the above-mentioned sealing surfaces may advantageously have sealing elements 130*a*, 130*b*, for example, elements taking the form of sealing disks. In the variant of the present invention shown in FIG. 3, the principle of the present invention, which is described above with reference to FIG. 1 and concerns the selection of the coefficient of thermal expansion of the material for the sealing element, may be applied to both the two sealing elements 130*a*, 130*b* and only one of the two.

All in all, the configuration illustrated in FIG. 3 produces reliable and stable sealing of interior chamber I of casing 110 from combustion chamber 14 of internal combustion engine 10; for example, laser device 26 (FIG. 5) being able to be situated in the interior chamber of the housing. The sealing is optimal when the principle of the present invention regarding the selection of the coefficient of thermal expansion of the material for the sealing element is applied to both sealing elements 130*a*, 130*b*, since this provides the maximum potential for offsetting the relatively low linear thermal expansion of combustion chamber window 120, using sealing elements 130*a*, 130*b*.

In this case, the preloading force F for joining at least one, which may be both, of the casing parts 110*a*, 110*b* to combustion chamber window 120 is generated by screwing inner sleeve 110*a* into outer sleeve 110*b* with the aid of thread G. This means that in each instance, essentially the same preloading force is generated for the two sealing elements 130*a*, 130*b*, that is, the relevant sealing surfaces between components 110*a*, 130*a*, 120 and 110*b*, 130*b*, 120.

According to a further, particularly advantageous specific embodiment, specifiable preloading force F is at least approximately 5 kN, which may be, approximately 15 kN, by which particularly reliable sealing of interior chamber I with respect to combustion chamber 14 is provided.

In a further advantageous specific embodiment, it is proposed that the connection between the at least one casing part 110*a* and combustion chamber window 120 have a helium-tightness of at least approximately $10^{-6}$ mbar×l/sec.

In a further specific embodiment, at least one of the casing parts 110*a*, 110*b*, but which may be both, have a tensile strength of at least approximately 1000 N per $mm^2$, which may be accomplished, for example, by selecting an appropriate type of steel, for example, ST 1.4913, as a material. It is particularly advantageous for steels having a high high-temperature strength and creep rupture strength to be used.

In a further advantageous specific embodiment, a maximum average surface roughness $R_{zmax}$≤approximately 6 is provided for regions of parts 110*a*, 110*b*, which are pressed against combustion chamber window 120 or sealing disks 130*a*, 130*b*. Sealing disks 130*a*, 130*b* themselves may also be manufactured, in turn, to have a comparable maximum average surface roughness.

According to a further specific embodiment, sealing element 130*a*, 130*b* may have a substantially disk-shaped or annular geometry with a parallelism between a base and a top surface of ≤approximately 10 μm, in particular, approximately 5 μm.

It is advantageous for the exact geometry of casing parts 110*a*, 110*b* in the region of combustion chamber window 120 to be selected in such a manner, that combustion chamber window 120 or sealing elements 130*a*, 130*b* may lie flat on corresponding shoulders 110*a*' (FIG. 1) and 110*b*' (FIG. 3), and thus, their surface normals are each parallel to optical axis OA (FIG. 3) of laser spark plug 100 and casing 110. For this, one must ensure that an outer diameter of sealing elements 130*a*, 130*b* or of combustion chamber window 120 is somewhat smaller than the inner diameter of the region of casing part 110*b* receiving these components. In particular, any existing inner radii caused by machining (e.g., due to a non-disappearing outer radius of a corner of a cutting tool that removes chips) must be taken into account, so that the outer edges of components 120, 130*a*, 130*b* do not come to rest on corresponding inner radii of casing part 110*b*, but on the end faces in region 110*b*' manufactured to be as flat as possible.

Casing 110 of the present invention may be obtained, for example, using the following manufacturing method: in a first step, casing parts 110*a*, 110*b* are pressed or preloaded against combustion chamber window 120 and sealing element 130*a*, 130*b*, which may be, at a specifiable preloading force F (FIG. 3). In this context, components 110*a*, 120, 130*a*, 130*b* are selected so as to satisfy the above-described principle of the present invention regarding the different coefficients of thermal expansion. During the pressing, casing parts 110*a*, 110*b* are interconnected in an advantageous manner, in particular, by screwing and/or welding and/or clamping or comparable techniques.

Optionally, after casing parts 110*a*, 110*b* have been joined to one another, a tempering step may still be carried out, which is used, inter alia, to allow a surface coating 140, e.g., of sealing elements 130*a*, 130*b* to set; the surface coating improving sealing action; the material creeping, in particular, into the surface indentations defined by the non-disappearing surface roughness of the components 110*a*, 110*b*, 120, 130*a*, 130*b* in question.

In a further advantageous specific embodiment, the screwing is carried out, using a specifiable torque profile; in particular, the torque profile may specify different tightening torques for different screw depths; for at least one screw depth, waiting times also being provided before the screwing operation is continued.

Generally, in the case of the screwing variant, the contact force F provided by the present invention (FIG. 3) may therefore be applied by screwing first casing part 110*a* together with second casing part 110*b* in a defined manner, thus, with a predetermined torque. For example, a torque wrench or a comparable tool may be used for this.

According to a specific embodiment of the present invention, the torque profile may provide, for example, that a tightening torque for the screwing operation be increased in steps, for example, from an initial value of 0 Nm (newton meter) to a final value of approximately 20 Nm. According to a further specific embodiment, a torque profile advantageously provides that certain screw depths 1 (FIG. 3) of casing parts 110*a*, 110*b* with respect to one another be reached using torque values of approximately 12 Nm and approximately 17 Nm; a final torque of approximately 20 Nm being used for ultimately producing contact force F proposed by the present invention. It is particularly advantageous for waiting times between the individual screwing stages to be from approximately 3 minutes to approximately 5 minutes long, in order to allow setting processes of the components to be screwed to set in, which further improve the sealing action.

In a further specific embodiment of the present invention, screw thread G (FIG. 1) has an M 16×2 thread.

Combustion chamber window 120 (FIG. 1) may be made of crystalline, in particular, monocrystalline sapphire having a high rigidity and good transmission characteristics at a laser wavelength used. In particular, combustion chamber window 120 may be formed and positioned in such a manner, that the C-axis (also zero-degree axis) of the crystal structure extends along optical axis OA of casing 110 (FIG. 3) and of laser device 26 (FIG. 6).

According to one specific embodiment, an outer diameter of combustion chamber window 120 may be approximately 12.7 mm.

The optically active surfaces of combustion chamber window 120 may be industrially polished, for example, of the type scratch/dig: 60/40. The edges of combustion chamber window 120 may be advantageously brushed or provided with a chamfer of, e.g., approximately 0.3 mm. In particular, the optically active surfaces of combustion chamber window 120 may be plane-parallel.

According to a specific embodiment, an outer diameter of sealing elements 130*a*, 130*b* is, for example, approximately 12.3 mm, thus, approximately 0.4 mm less than the outer diameter of combustion chamber window 120. In this manner, sealing elements 130*a*, 130*b* advantageously do not rest on the manufacturing chamfer in region 110*b*' (FIG. 3) of plug casing 110.

It is advantageous for an inner diameter of sealing elements 130*a*, 130*b*, through which laser beam 24 (FIG. 1, 6) may be emitted, to be approximately 8 mm, at least approximately 6 mm.

Figure 4:
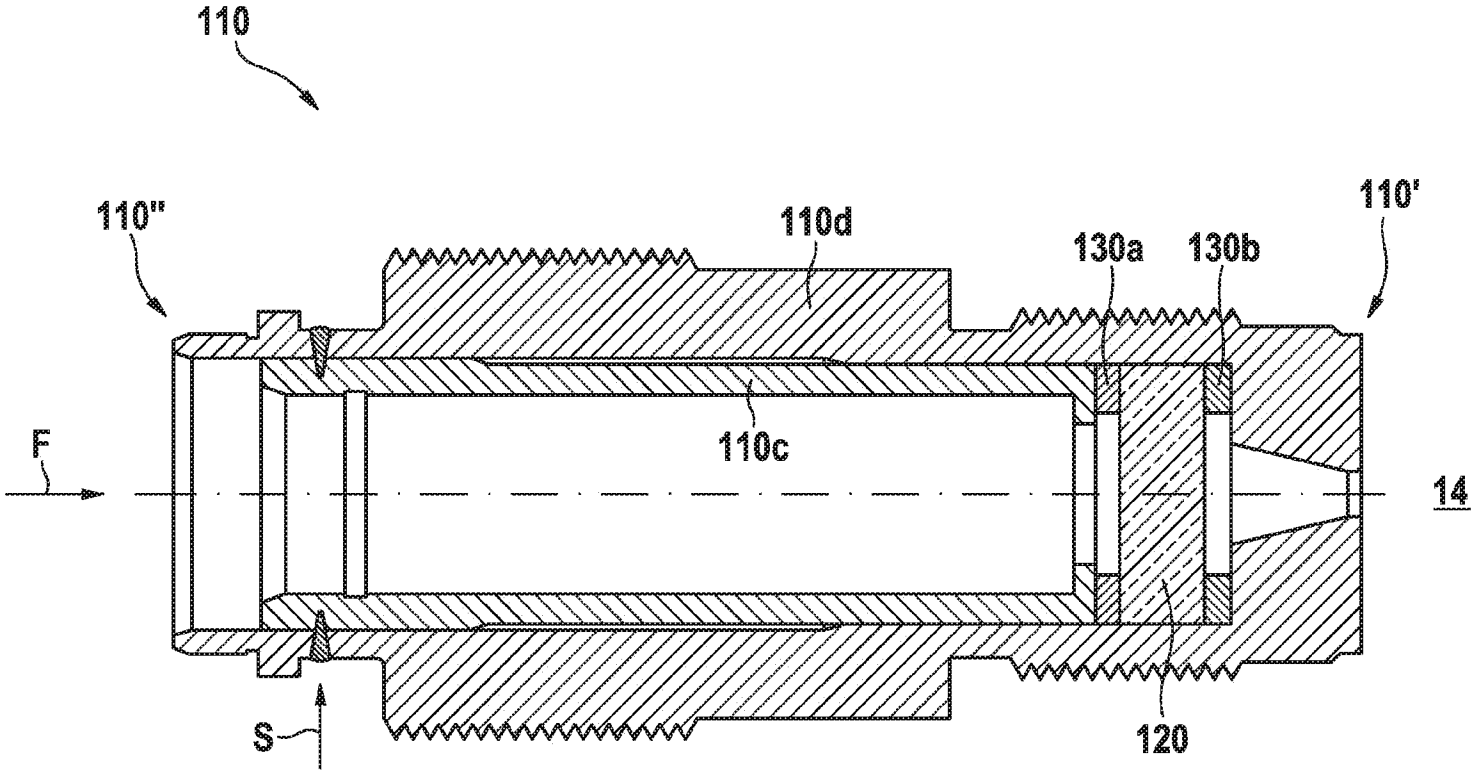
FIG. 4 shows a schematic cross section of a further specific embodiment of the casing according to the present invention.

FIG. 4 shows a cross section of a further specific embodiment of a casing 110 according to the present invention. A first casing part 110*c* is formed, again, to be substantially sleeve-shaped and is coaxially situated, along its entire length, and thus, completely, in a second casing part 110*d*, which is also approximately sleeve-shaped. Combustion chamber window 120 is surrounded, in turn, by disk-shaped sealing elements 130*a*, 130*b*, which produce, together with the corresponding end faces of casing parts 110*c*, 110*d*, the sealing action rendered possible by the present invention.

According to the present invention, a coefficient of thermal expansion of at least one of the sealing elements 130*a*, 130*b* at the operating temperature of laser spark plug 100 is greater than the coefficient of thermal expansion of casing part 110*d* and 110*c* at the operating temperature of laser spark plug 100, which means that, in turn, the lower coefficient of thermal expansion of the combustion chamber window 120 presently made of monocrystalline sapphire, at the operating temperature of laser spark plug 100, may be at least partially compensated for.

In contrast to the specific embodiment shown in FIG. 3, casing 110 in FIG. 4 does not have a screw connection between casing parts 110*c*, 110*d*. Rather, a continuous material connection of casing parts 110*c*, 110*d* is produced by welding, in particular, laser welding, in this case, in the region of arrow S. It may advantageously be a circumferential welded seam, which produces a particularly rigid connection of components 110*c*, 110*d*. In this case, contact force F between casing parts 110*c*, 110*d* and combustion chamber window 120 is advantageously generated by initially pressing or bracing sleeves 110*c*, 110*d* against each other prior to welding, namely, with contact force F. Only then is the continuous material connection produced in region S by laser welding. In this manner, it is advantageously ensured that contact force F proposed by the present invention is also maintained for the future, that is, after external contact force F ceases to be applied. During the manufacture of casing 110, contact force F may be generated, for example, using a press known per se. After the laser welding, a process of tempering may be carried out again, as well as a slow cool-off to room temperature.

FIG. 5 shows a cross-sectional view of a further specific embodiment of a casing 110 according to the present invention. In contrast to the specific embodiments described above with reference to FIGS. 3, 4, in this case, casing 110 has a so-called sealing configuration screwed in on the side of the combustion chamber, where a first casing part 110*e* ("front cap") is screwed from combustion chamber 14 or combustion-chamber side end 110' into second casing part 110*f* Preloading force F and, therefore, the sealing action, is produced in a manner comparable to the specific embodiments described above.

Analogously to the specific embodiment shown in FIG. 1, only one sealing element 130*c* is illustrated in the configuration shown in FIG. 5. The explanations above apply to the coefficients of thermal expansion of components 110*e*, 110*f*, 120, 130*c*.

As an option, a further sealing element (not shown) may also be provided between combustion chamber window 120 and the step-change in inner diameter of casing part 110*f* situated to the left of it.

Casing part 110*e* advantageously includes a driving profile, which is not shown in further detail in FIG. 5 and allows casing part 110*e* to be screwed into second casing part 110*f* in a simple manner.

In a further advantageous specific embodiment, the dimensioning specification explained below in further detail is provided for the axial dimensions of the components of combustion chamber window 120 and sealing element 130*a* or sealing elements 130*a*, 130*b*. As already described above, the axial dimension of combustion chamber window 120 is designated in FIG. 1 by double arrow d2 and, in this case, is also referred to as the thickness of combustion chamber window 120. The axial dimension of sealing element 130*a* is denoted in FIG. 1 by double arrow d1, and analogously to the thickness of combustion chamber window 120, it is also referred to as thickness d1 of sealing element 130*a*. In the present specific embodiment, the following dimensioning specification is advantageously provided:

$$\frac{l_{window}}{l_{sealing\ element}} = \frac{\alpha_{casing} - \alpha_{sealing\ element}}{\alpha_{window} - \alpha_{casing}},$$

where $l_{window}$ refers to thickness d2 of combustion chamber window 120 as shown in FIG. 1, $l_{sealing\ element}$ refers to thickness d1 of sealing element 130*a* as shown in FIG. 1, and variables $\alpha_{casing}$, $\alpha_{sealing\ element}$, $\alpha_{window}$ denote the coefficients of thermal expansion of the components: casing 110*a*, 110*b* (FIG. 1), sealing element 130*a*, and combustion chamber window 120.

In specific embodiments that only contain one sealing element 130*a* (FIG. 1), 130*c* (FIG. 5) next to combustion chamber window 120, the thickness $l_{sealing\ element}$ indicated in the above formula corresponds to thickness d1 of the only sealing element 130*a*. In specific embodiments, in which two sealing elements 130*a*, 130*b* are provided in the region of combustion chamber window 120, cf., e.g., FIG. 3, the variable $l_{sealing\ element}$ of the above formula corresponds to the sum of the individual thicknesses of the two sealing elements 130*a*, 130*b*, since in this case, in a layout of their thermal expansion coefficients according to the present invention, the two sealing elements 130*a*, 130*b* interact to compensate for the relatively low thermal expansion of combustion chamber window 120 or adapt it to the relatively high thermal expansion of casing parts 110*a*, 110*b*.

What is claimed is:

1. A casing for a laser spark plug, comprising:

a casing part;

a combustion chamber window joined to the casing part to form a seal at least regionally; and at least one sealing element, whose coefficient of thermal expansion at an operating temperature of the laser spark plug is greater than the coefficient of thermal expansion of the casing part at the operating temperature of the laser spark plug, and which is between the casing part and the combustion chamber window, such that the combustion chamber window, the at least one sealing element, and the casing part are arranged, in that order, sequentially in a direction of an optical axis of the laser spark plug, wherein:

in a region of contact with the casing part and/or with the combustion chamber window, the sealing element has a coating made of a material, which is different from a base material of the sealing element, the coating is applied to the base material and has a first thickness of approximately 50 μm to approximately 150 μm, and the base material has a second thickness that is greater than the first thickness.

2. The casing of claim 1, wherein the coefficient of thermal expansion of the combustion chamber window at the operating temperature of the laser spark plug is less than the coefficient of thermal expansion of the casing part at the operating temperature of the laser spark plug.

3. The casing of claim 1, wherein the coefficient of thermal expansion of the combustion chamber window at the operating temperature of the laser spark plug is between approximately 4*10^−6/K and approximately 10*10^−6/K.

4. The casing of claim 1, wherein the coefficient of thermal expansion of the casing part at the operating temperature of the laser spark plug is between approximately 7*10^−6/K and approximately 16*10^−6/K.

5. The casing of claim 1, wherein the coefficient of thermal expansion of the sealing element at the operating temperature of the laser spark plug is between approximately 16*10^−6/K and approximately 20*10^−6/K.

6. The casing of claim 1, wherein the casing part and/or the sealing element is made of steel, and the combustion chamber window is made of sapphire.

7. The casing of claim 1, wherein the coefficient of thermal expansion of the combustion chamber window at the operating temperature of the laser spark plug is between approximately 4*10^−6/K and approximately 8*10^−6/K.

8. The casing of claim 1, wherein the coefficient of thermal expansion of the casing part at the operating temperature of the laser spark plug is between approximately 7*10^−6/K and approximately 12*10^−6/K.

9. The casing of claim 1, wherein the coefficient of thermal expansion of the sealing element at the operating temperature of the laser spark plug is between approximately 16*10^−6/K and approximately 18*10^−6/K.

10. The casing of claim 1, wherein the casing part and/or the sealing element is made of steel, and the combustion chamber window is made of monocrystalline sapphire.

11. The casing of claim 1, wherein, in a region of contact with the casing part and/or with the combustion chamber window, the sealing element has a coating made of a material, which is different from the base material of the sealing element, the base material being made of steel and the coating being made of copper.

12. The casing of claim 1, wherein:

the casing part includes a first end face that is positioned at a first coordinate of, and is not parallel to, the optical axis;

the combustion chamber window includes a second end face that is positioned at a second coordinate of, and is not parallel to, the optical axis; and the at least one sealing element is positioned between the first and second coordinates of the optical axis.

13. The casing of claim 1, wherein the coating is galvanically deposited on the sealing element.

14. A laser spark plug, comprising:

a casing for the laser spark plug, including a casing part, a combustion chamber window joined to the casing part to form a seal at least regionally, and at least one sealing element;

wherein:

the coefficient of thermal expansion of the at least one sealing at an operating temperature of the laser spark plug is greater than the coefficient of thermal expansion of the casing part at the operating temperature of the laser spark plug;

the at least one sealing element is positioned between the casing part and the combustion chamber window, such that the combustion chamber window, the at least one sealing element, and the casing part are arranged, in that order, sequentially in a direction of an optical axis of the laser spark plug; and the operating temperature of the laser spark plug is between approximately 200° C. and approximately 1100° C., wherein:

in a region of contact with the casing part and/or with the combustion chamber window, the sealing element has a coating made of a material, which is different from a base material of the sealing element, the coating is applied to the base material and has a first thickness of approximately 50 μm to approximately 150 μm, and the base material has a second thickness that is greater than the first thickness.

15. The laser spark plug of claim 14, wherein the operating temperature of the laser spark plug is between approximately 280° C. and approximately 600° C.

16. The laser spark plug of claim 14, wherein the laser spark plug is of an internal combustion engine of a motor vehicle or of a stationary engine.

17. A casing for a laser spark plug, comprising:
at least one casing part;
a combustion chamber window joined to the casing part to form a seal at least regionally; and
at least one sealing element, whose coefficient of thermal expansion at an operating temperature of the laser spark plug is greater than the coefficient of thermal expansion of the casing part at the operating temperature of the laser spark plug, is between the casing part and the combustion chamber window;
wherein at least one of:
a thickness of the sealing element is between approximately 0.4 mm and approximately 3 mm;
a thickness of the combustion chamber window is between approximately 2 mm and approximately 8 mm;
in a region of contact at least one of (a) with the at least one casing part and (b) the combustion chamber window, the sealing element includes at least one of:
a lapped surface; and
a coating in the form of a foil and made of a material that is different from a base material of the sealing element, a thickness of the coating being approximately 50 μm to approximately 150 μm;
the at least one casing part is pressed against the combustion chamber window with a specifiable preloading force; and
the at least one sealing element includes two or more sealing elements, whose coefficients of thermal expansion at the operating temperature of the laser spark plug are different from each other, are provided between the casing part and the combustion chamber window.

18. The casing of claim 17, wherein the thickness of the sealing element is between approximately 0.4 mm and approximately 3 mm.

19. The casing of claim 18, wherein the thickness of the sealing element is between approximately 0.4 mm and approximately 1.0 mm.

20. The casing of claim 17, wherein the thickness of the combustion chamber window is between approximately 2 mm and approximately 8 mm.

21. The casing of claim 20, wherein the thickness of the combustion chamber window is between approximately 2 mm and approximately 4 mm.

22. The casing of claim 17, wherein the sealing element includes the lapped surface in the region of contact.

23. The casing of claim 17, wherein the sealing element includes the coating in the region of contact.

24. The casing of claim 17, wherein the at least one casing part is pressed against the combustion chamber window with the specifiable preloading force.

25. The casing of claim 17, wherein the at least one sealing element includes the two or more sealing elements provided between the casing part and the combustion chamber window.

26. A laser spark plug, comprising:
a casing for the laser spark plug, including at least one casing part, a combustion chamber window joined to the casing part to form a seal at least regionally, and at least one sealing element, whose coefficient of thermal expansion at an operating temperature of the laser spark plug is greater than the coefficient of thermal expansion of the casing part at the operating temperature of the laser spark plug, is between the casing part and the combustion chamber window;
wherein:
the laser spark plug has an operating temperature of between approximately 200° C. and approximately 1100° C.; and
at least one of:
a thickness of the sealing element is between approximately 0.4 mm and approximately 3 mm;
a thickness of the combustion chamber window is between approximately 2 mm and approximately 8 mm;
in a region of contact at least one of (a) with the at least one casing part and (b) the combustion chamber window, the sealing element includes at least one of:
a lapped surface; and
a coating in the form of a foil and made of a material that is different from a base material of the sealing element, a thickness of the coating being approximately 50 μm to approximately 150 μm;
the at least one casing part is pressed against the combustion chamber window with a specifiable preloading force; and
the at least one sealing element includes two or more sealing elements, whose coefficients of thermal expansion at the operating temperature of the laser spark plug are different from each other, are provided between the casing part and the combustion chamber window.

27. The laser spark plug of claim 26, wherein the thickness of the sealing element is between approximately 0.4 mm and approximately 3 mm.

28. The laser spark plug of claim 26, wherein the thickness of the combustion chamber window is between approximately 2 mm and approximately 8 mm.

29. The laser spark plug of claim 26, wherein the sealing element includes the lapped surface in the region of contact.

30. The laser spark plug of claim 26, wherein the sealing element includes the coating in the region of contact.

31. The laser spark plug of claim 26, wherein the at least one casing part is pressed against the combustion chamber window with the specifiable preloading force.

32. The laser spark plug of claim 26, wherein the at least one sealing element includes the two or more sealing elements provided between the casing part and the combustion chamber window.

* * * * *